United States Patent [19]

Daigaku

[11] 4,337,383

[45] Jun. 29, 1982

[54] EARPHONE JACK FOR TAPE RECORDERS

[75] Inventor: Masaaki Daigaku, Hachioji, Japan

[73] Assignee: Olympus Optical Co., Ltd., Tokyo, Japan

[21] Appl. No.: 145,247

[22] Filed: Apr. 30, 1980

[30] Foreign Application Priority Data

May 25, 1979 [JP] Japan ..... 54/70356[U]

[51] Int. Cl.[3] ..... H01H 1/28

[52] U.S. Cl. ..... 200/51.09; 200/51.1; 179/1 SW

[58] Field of Search ..... 200/51 R, 51.09, 51.1, 200/51.05, 283; 179/1 A, 1 SW; 339/183

[56] References Cited

U.S. PATENT DOCUMENTS 1,586,512 6/1926 Adair ..... 179/1 SW
2,768,234 10/1956 Popp ..... 200/51.1
3,045,078 7/1962 Frantz et al. ..... 200/51.1
3,204,053 8/1965 Bilek ..... 200/51.09

OTHER PUBLICATIONS

P. Abramson, On-Off Switch, IBM Technical Disclosure Bulletin, vol. 11, No. 10, Mar. 1969.

*Primary Examiner*—John W. Shepperd
*Attorney, Agent, or Firm*—Frishauf, Holtz, Goodman & Woodward

[57] ABSTRACT

An earphone jack for tape recorders, into which an earphone plug is inserted, which comprises a housing having an earphone plug insertion hole, an earphone/-speaker changeover switch having a fixed contact and a movable contact moved by the insertion of the earphone plug so that it is electrically separated away from the fixed contact to cause the earphone/speaker changeover switch to be turned OFF, and a muting switch disposed in said housing and operated by the operation of the earphone/speaker changeover switch.

5 Claims, 5 Drawing Figures

EARPHONE JACK FOR TAPE RECORDERS

BACKGROUND OF THE INVENTION

This invention relates to an earphone jack for tape recorders which includes a muting switch and an earphone/speaker changeover switch and is adapted to operate the muting switch in interlock with a switching operation between an earphone and a speaker.

Generally, an earphone jack which renders a muting switch and earphone/speaker changeover switch directly ON when an earphone plug is inserted is known. It is desired that after the earphone/speaker changeover switch is turned ON, i.e. a connection to a reproducing amplifier is switched from a speaker to an earphone, the muting switch be operated so as to prevent "howling". In such a conventional earphone jack having both of the switches driven by the plug, it is difficult to positively cause operation of both of the switches with such a timing to meet the above-mentioned requirement. Furthermore, "howling" tends to be developed due to some error in manufacture as well as to deformation or fatigue of the switch under use for a long time.

SUMMARY OF THE INVENTION

It is accordingly an object of this invention to provide an earphone jack for tape recorders which, even if some error in manufacture as well as fatigue or deformation under use for a long time is involved, is operated after the operation of the earphone/speaker changeover switch so as to positively prevent "howling".

DETAILED DESCRIPTION OF THE PREFERRED EMBODIMENT

Figure 1:
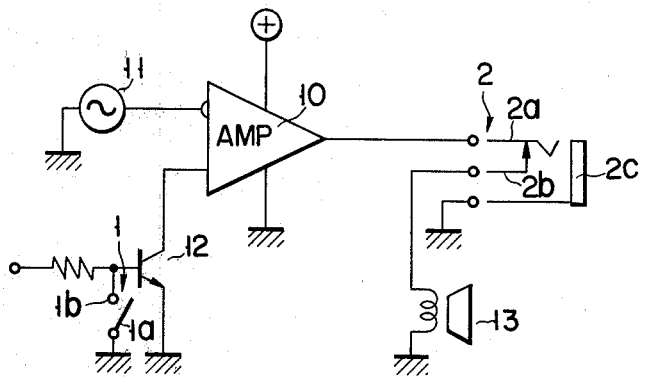
FIG. 1 is a view showing an equivalent circuit of a major portion of a tape recorder equipped with an earphone jack according to one embodiment of this invention.
Figure 2:
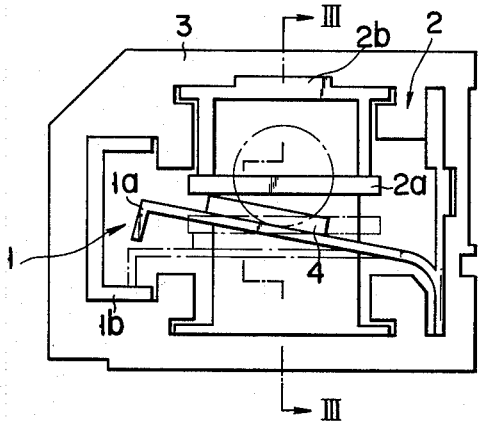
FIG. 2 is a rear view showing the earphone jack of FIG. 1.
Figure 3:
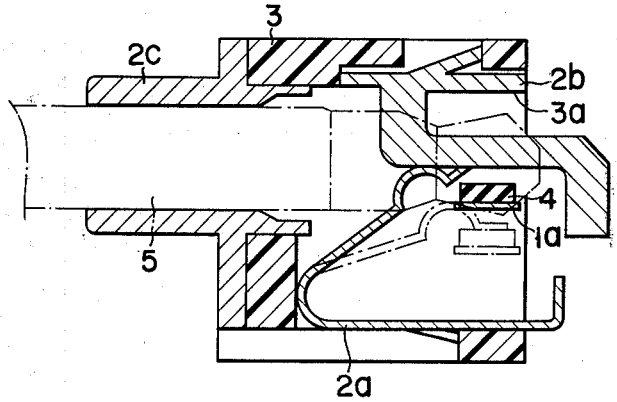
FIG. 3 is a cross-sectional view taken along line III—III in FIG. 2.

FIG. 1 shows an equivalent circuit showing the relationship of a muting switch and an earphone/speaker changeover switch incorporated into an earphone jack, to the other circuit elements of a tape recorder. Reference numeral 10 shows a reproducing amplifier connected at one input terminal to a signal source 11 and at the other input terminal to the collector of a transistor 12, the emitter of the transistor 12 being grounded. A fixed contact 1*b* of the muting switch 1 is connected to the base of the transistor 12 and a movable contact 1*a* of the muting switch 1 is grounded. The output terminal of the reproducing amplifier 10 is connected to a movable contact 2*a* of the earphone/speaker changeover switch 2, and a fixed contact 2*b* (for speaker) of the switch 2 is connected to a speaker 13. During the reproduce mode as shown, both the contacts 2*a* and 2*b* are electrically connected to each other and the fixed contact 2*c* (for earphone) of the switch 2 is electrically separated away from the movable contact 2*a*. In the circuit arrangement as shown, the switching of a record mode is effected by an LSI not shown, thereby obviating the necessity of a mechanical switch. When monitoring during operation in the record mode time, the movable contact 2*a* of the earphone/speaker changeover switch 2 is moved by inserting the earphone plug into the jack. As a result, the movable contact 2*a* of the switch 2 is moved away from the fixed contact 2*b* (for speaker). Thereafter, the movable contact 1*a* of the muting switch 1 is moved into electrical contact with the fixed contact 1*b*. In order to prevent "howling" it is necessary that in such a series of operations the muting switch 1 be turned ON after the "ON" operation of the earphone/speaker changeover switch 2. This operation can be positively effected in the earphone jack of this invention as shown in FIGS. 2 and 3. In these Figures, reference numeral 3 shows a housing made of synthetic resin and the muting switch 1 and earphone/speaker changeover switch 2 are disposed in a through bore 3*a* of the housing. The basic end of the movable contact 1*a* of the muting switch 1 is fixedly fitted into a recess formed at a lower portion of one side of the housing, and the free end of the movable contact 1*a* extends such that it traverses the through hole of the housing 3. The fixed contact 1*b* is substantially U-shape and is fixedly fitted into a recess formed in the other side of the housing 3 and the lower end portion of the fixed contact 1*b* the free end of the movable contact 1*a*. When the free end of the movable contact 1*a* is depressed, it is contacted with the lower portion of the fixed contact 1*b* to cause the switch 1 to be turned ON. An electrical insulating member 4 is fixed on the movable contact 1*a* of the switch 1 and the free end portion of the movable contact 2*a* of the earphone/speaker changeover switch 2 is disposed on or above the insulating member 4. Although in this embodiment the free end portion of the movable contact 2*a* is beforehand contacted with the insulating member 4, this is not necessarily required. It is only sufficient if the free end portion of the movable contact 2*a* is disposed in proximity to the insulating member 4. The movable contact 2*a* has a down turned portion at the base end portion, and the down turned portion and the middle portion of the contact 2*a* are fixed with respect to the housing 3 by being pressure contacted with the housing 3 at the front and rear sides of the housing 3. One fixed contact 2*b* of the switch 2 is forced into a recess formed at the upper portion of the housing 3 and fixed there. As evident from FIG. 3, the fixed contact 2*b* is electrically contacted with the free end of the movable contact 2*a*. The fixed contact 2*c* of the switch 2, i.e. the fixed contact for the earphone, is provided, as in the prior art, such that it extends in the plug insertion hole of the housing 3.

When the plug 5 is inserted into the jack as indicated by a phantom line in FIG. 3 the movable contact 2*a* of the earphone/speaker changeover switch 2 is moved downward. As a result, the movable contact 2*a* of the switch 2 is electrically separated from the fixed contact 2*b*. At this time, the movable contact 1*a* of the switch 1 is moved downward through the insulating member 4 to permit it to be electrically connected with the fixed contact 1*b*. That is, the earphone/speaker changeover switch 2 is operated by the plug 5 and the muting switch 1 is operated by the operation of the switch 2. As a result, the switches 1 and 2 are sequentially positively operated irrespective of the timing accuracy and irrespective of the fatigue or deformation of the contact resulting from use for a long period of time.

Although in the above-mentioned embodiment explanation has been given for the case where the muting switch 1 is beforehand in the OFF state, and is turned on by insertion of the plug. It is possible that with the muting switch 1 beforehand ON the muting switch 1 is rendered OFF when the earphone plug is inserted into the jack. This embodiment will be explained below by referring to FIGS. 4 and 5.

Figure 4:
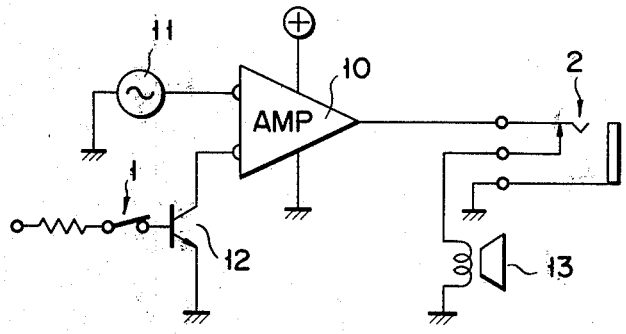
FIG. 4 is a view showing an equivalent circuit, similar to that of FIG. 1, relating to an earphone jack according to another embodiment of this invention.
Figure 5:
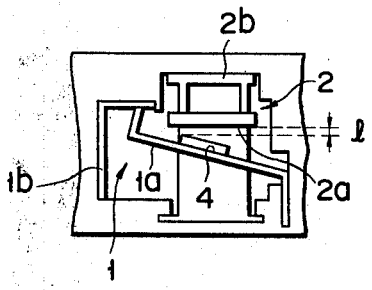
FIG. 5 is a rear view showing an earphone jack according to another embodiment of this invention.

FIG. 4 shows an equivalent circuit similar to that of FIG. 1. A muting switch 1 is connected directly to the base of a transistor 12, the collector of the transistor 12 being connected to an amplifier 10. The jack as shown in FIG. 5 has an arrangement for the above-mentioned circuit and the free end portion of the movable contact 1*a* of the muting switch 1 is upwardly urged by its own elastic force into contact with the upper portion of the fixed contact 1*b*. An insulating member 4 is attached to the upper surface of the movable contact 1*a*. Above the insulating member 4 a movable contact 2*a* of the earphone/speaker changeover switch 2 is disposed with a predetermined spacing l left with respect to the insulating member 4. As in the above-mentioned embodiment, the movable contact 2*a* is electrically contacted with a fixed contact 2*b* and the speaker 13 is thereby electrically connected to the amplifier 10.

When the earphone plug is inserted into the jack, the movable contact 2*a* of the earphone/speaker changeover switch 2 is depressed downward to cause the switch 2 to be turned OFF. When the movable contact 2*a* is depressed a predetermined distance the movable contact 1*a* of the muting switch 1 is depressed downward through the insulating member 4 to permit the free end of the movable contact 1*a* to be spaced away from the fixed contact 1*b*. As a result, the muting switch 1 is turned OFF to permit monitoring to be effected by the earphone.

In the earphone jack so constructed in accordance with the invention, the earphone/speaker changeover switch is operated by the earphone plug and by this operation the muting switch is operated. Even if some manufacturing error is involved in component parts constituting the switches or even if fatigue or deformation occurs due to use for a long period of time, monitoring can be effected without involving a howling phenomenon.

What is claimed is:

1. An earphone jack for tape recorders, into which an earphone plug is insertable, comprising:

a housing having an earphone plug insertion hole and a pair of recesses, one recess being at one side of the housing and the other recess being at the other side of the housing;

an earphone/speaker changeover switch disposed in said housing and having a movable contact which is moved responsive to inserting the earphone plug into said insertion hole of said housing;

a muting switch disposed in said housing and having a fixed contact and a movable contact which are mounted in respective recesses of said housing so that they are fixedly mounted relative to said housing, said movable contact of said muting switch being operatively coupled to said movable contact of said earphone/speaker changeover switch so as to be movable by the movement of said movable contact of said earphone/speaker changeover switch to a position where it is electrically contacted with said fixed contact of said muting switch to cause said muting switch to be turned ON; and an insulating member disposed in said housing and being operatively coupled between said movable contact of said muting switch and said movable contact of said earphone/speaker changeover switch, said movable contact of said earphone/speaker changeover switch moving said movable contact of said muting switch through said insulating member.

2. An earphone jack for tape recorders, into which an earphone plug is insertable, comprising:

a housing having an earphone plug insertion hole and a pair of recesses, one recess being at one side of the housing and the other recess being at the other side of the housing;

an earphone/speaker changeover switch disposed in said housing and having a movable contact which is moved responsive to inserting of the earphone plug into said insertion hole of said housing;

a muting switch disposed in said housing and having a fixed contact and a movable contact which are mounted in respective recesses of said housing so that they are fixedly mounted relative to said housing, said movable contact of said muting switch being operatively coupled to said movable contact of said earphone/speaker changeover switch so as to be movable by the movement of said movable contact of said earphone/speaker changeover switch to a position where it is electrically separated from said fixed contact of said muting switch to cause said muting switch to be turned OFF; and an insulating member disposed in said housing and being operatively coupled between said movable contact of said muting switch and said movable contact of said earphone/speaker changeover switch, said movable contact of said earphone/speaker changeover switch moving said movable contact of said muting switch through said insulating member.

3. The earphone jack of claim 1 or 2, wherein said housing has an additional recess into which said fixed contact of said earphone/speaker changeover switch is received so that it is fixed relative to said housing; and said movable contact of said earphone/speaker changeover switch has a raised portion sandwiched at opposite sides of said housing.

4. The earphone jack of claim 1 or 2, wherein said insulating member is disposed on at least a portion of said movable contact of said muting switch to prevent electrical contact between said movable contact of said muting switch and said movable contact of said earphone/speaker changeover switch.

5. The earphone jack of claim 1 or 2, wherein said movable contact of said muting switch is a resilient elongated contact fixedly mounted at one end thereof in one of said recesses of said housing.

* * * * *